US009010231B1

(12) United States Patent
Cohn et al.

(10) Patent No.: US 9,010,231 B1
(45) Date of Patent: Apr. 21, 2015

(54) COMBINED BULLETPROOF SHIELD AND DESK ITEM

(71) Applicants: Michael H. Cohn, Pittsford, NY (US); Susan M. Vernille, Webster, NY (US)

(72) Inventors: Michael H. Cohn, Pittsford, NY (US); Susan M. Vernille, Webster, NY (US)

( * ) Notice: Subject to any disclaimer, the term of this patent is extended or adjusted under 35 U.S.C. 154(b) by 0 days.

(21) Appl. No.: 13/631,316

(22) Filed: Sep. 28, 2012

Related U.S. Application Data

(60) Provisional application No. 61/626,536, filed on Sep. 28, 2011.

(51) Int. Cl.
*F41H 5/08* (2006.01)

(52) U.S. Cl.
CPC ..... *F41H 5/08* (2013.01)

(58) Field of Classification Search
USPC ..... 89/36.01, 36.02, 36.05, 36.07; 428/911; 109/49.5
See application file for complete search history.

(56) References Cited

U.S. PATENT DOCUMENTS

| | | | | |
|---|---|---|---|---|
| 3,866,242 | A * | 2/1975 | Slagel | 2/2.5 |
| D258,293 | S | 2/1981 | Macowski | |
| 4,442,780 | A * | 4/1984 | Child | 109/29 |
| 4,546,863 | A * | 10/1985 | Kaufman | 190/102 |
| 4,782,735 | A * | 11/1988 | Mui et al. | 89/36.07 |
| 4,919,037 | A * | 4/1990 | Mitchell | 89/36.05 |
| 5,329,636 | A * | 7/1994 | Siddle | 2/463 |
| 6,000,347 | A * | 12/1999 | Madden, Jr. | 109/49.5 |
| 6,170,379 | B1 * | 1/2001 | Taylor | 89/36.07 |
| 7,146,899 | B2 * | 12/2006 | Imblum et al. | 89/36.01 |
| D572,763 | S | 7/2008 | Neiser | |
| 7,712,408 | B1 * | 5/2010 | Copeland et al. | 89/36.01 |
| 7,736,012 | B1 * | 6/2010 | Chu et al. | 362/98 |
| 7,988,237 | B2 * | 8/2011 | Peters | 297/463.2 |
| 8,210,088 | B1 * | 7/2012 | Keyfauver | 89/36.05 |
| 8,408,114 | B1 * | 4/2013 | Tan | 89/36.02 |
| 2005/0257678 | A1 * | 11/2005 | Camp | 89/36.07 |

OTHER PUBLICATIONS

Armor Dynamics, Ballistic Bag Insert, at least as early as May 2011.
Armor Dynamics, Bulletproof Mouse Pad, at least as early as May 2011.
Armor Dynamics, Multi-Purpose Shield, at least as early as May 2011.
USA Custom Pad, Premium Vinyl Blank Desk Pads and Pad Refills, printout from web site at http://www.deskpads.com/premium-vinyl-blank-desk-pads.html, Sep. 27, 2011.
The Elegant Office, Black Leather 34×20 Desk Pad w/Blotter Paper, printout from web site at http://www.theelegantoffice.com, Sep. 27, 2011.

(Continued)

*Primary Examiner* — Samir Abdosh
*Assistant Examiner* — John D Cooper
(74) *Attorney, Agent, or Firm* — Kenneth J. Lukacher Law Group

(57) ABSTRACT

An apparatus is provided having a rigid bulletproof member enclosed in a housing of flexible material. A pair of handles is coupled to the housing to enable a user to operate the apparatus in a first mode by grasping the handles and locating the housing to shield the user from one or more bullets, and at other times in a second mode with the back surface of the housing upon a desk or other surface. In the second mode that apparatus serves as a typical desktop item of a desk pad enabled by providing multiple holders along the front surface for retaining one or more corners or a portion of the top and/or bottom of a rectangular member or item, such as a desktop calendar, blotter paper or media, paper pad, or the like.

11 Claims, 5 Drawing Sheets

(56) References Cited

OTHER PUBLICATIONS

Automotive Armor Manufacturing, Welcome to Automotive Armor Manufacturing, Armor Shield, printout from web site at http://www.auto-armor.com/, Jun. 21, 2011.

Armor Dynamics, Ballistic Clipboard Insert, at least as early as May 2011.

Armor Dynamics, Ballistic Sun Visor, at least as early as May 2011.

Armor Dynamics, Ballistic Notebook Insert, at least as early as May 2011.

* cited by examiner

COMBINED BULLETPROOF SHIELD AND DESK ITEM

This application claims the benefit of priority to U.S. Patent Application No. 61/626,536, filed Sep. 28, 2011.

FIELD OF THE INVENTION

The present invention relates to an apparatus providing a bulletproof shield, and particularly to an apparatus combining a bulletproof shield with a desktop item which can lie and be utilized upon the top surface of desk (or other surface). The apparatus of the present invention is useful for providing a common desktop item upon a desk (or other surface) that is readily graspable by handles along the apparatus for use as a shield by a person sitting or standing behind or near the desk for gun violence protection.

BACKGROUND OF THE INVENTION

Occurrences of gun violence in the workplace or schools has been a growing problem in society today. When such environments become dangerous, often executives, school boards, front lobby, security, supervisors, principals, or persons of high positions in offices, are the most vulnerable as being potential targets. It would be advantageous to have an item typically present in an office, which easily be handled and serve as a protective device from gun violence when needed.

U.S. Pat. No. 6,170,379 describes a school desk in which the entire top of the desk is bullet resistant and is releasably attached by clip(s) to the frame of the desk. Requiring the entire top of a desk to be detached from the desk frame before its use as a shield is undesirable since it delays use of the top of the desk as shield, and moreover the attaching clip(s) can jam or be difficult to release when needed. Other devices such as bulletproof clipboards as described for example in U.S. Pat. No. 7,712,408, or mouse pads, such as sold by Armor Dynamics of Kingston N.Y., are of inadequate size to protect the entire upper body (or a substantial portion thereof) when used as a shield, undesirably leaving vital areas of a user's body unprotected and thus vulnerable to gunfire.

Thus it would be desirable to provide a bulletproof shield, and particularly to an apparatus combining a bulletproof shield with a desktop item which can lie and be utilized upon the top surface of desk in an unattached relationship, and when needed be held by a user to protect substantially or entirely the upper portion of a user's body.

SUMMARY OF THE INVENTION

Accordingly, it is an object of the present invention is provide a bulletproof shield combined with a desktop item which may lie upon the top surface of desk (or other surface) and when needed be handled as a shield from one or more bullets.

Another object of the present invention is to provide a bulletproof shield usable as desktop office item which when held by a user can shield substantially or entirely the upper portion of the user's body.

Briefly described, the present invention embodies an apparatus having a rigid bulletproof member or panel, and a housing or bag of flexible material which encloses the bulletproof member. A pair of handles are coupled to the housing to enable a user to operate the apparatus in a first mode by grasping one of the handles in each hand and locating the housing to shield the user from one or more bullets, and at other times in a second mode with the back surface of the housing upon the top surface of a desk (or other surface).

In the second mode, the apparatus serves as a typical desktop item of a desk pad enabled by providing multiple holders along the front surface for retaining one or more corners or a portion of the top and/or bottom of a rectangular member or item, such as a desktop calendar, blotter paper or media, paper pad, or the like. The holders facilitate use of the apparatus in its second mode as a common desk item, such as may be present in workplaces or schools. Often, the apparatus replaces an existing desktop item in office or other workplaces or schools, but unlike a common desktop item the apparatus of the present invention can also be readily handled as a bulletproof shield, if ever needed for such purpose.

When used as a shield in the first mode, the apparatus is sized to enable shielding of substantially, if not entirely, the entire upper body portion of the user (e.g., upper torso, head, neck, arms, hands). For example, the apparatus can be positioned upright or at a tilt with only its bottom end adjacent or touching desk surface with a user sitting in a chair behind the desk with legs underneath the desk so that his or her upper body portion can be protected by apparatus from gunfire (e.g., with head ducked behind the apparatus), while the lower body portion has some protection afforded by the desk itself, thereby enabling a level of total body protection. Further the apparatus can be held by the user in other user body positions, such as standing, to shield substantially or entirely the upper body portion of the user with its back surface facing possible on-coming gunfire.

Preferably, the pair of handles is attached to front surface where each handle is near opposite sides of the housing centered between the housing's top and bottom ends.

The housing may have a closed bottom end and an open top end through which the bulletproof member is received in the housing, and a mechanism for releasably closing the open end when the bulletproof member is received in the housing.

Although use is described in an office or other workplaces or schools, the apparatus is not limited to such use, but can be used in any environment where a protective bulletproof device may be needed, which can also serve as a desktop item of a desk pad.

BRIEF DESCRIPTION OF THE DRAWINGS

The foregoing objects, features and advantages of the invention will become more apparent from a reading of the following description in connection with the accompanying drawings in which.

DETAILED DESCRIPTION OF THE INVENTION

Figure 3:
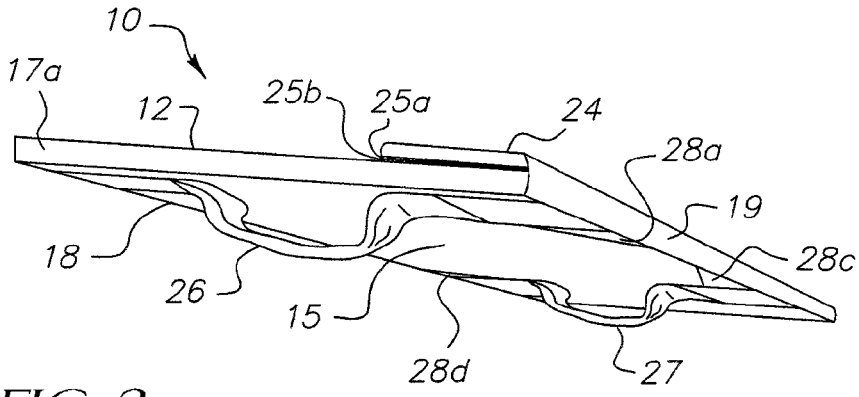
FIG. 3 is a perspective view of the apparatus of FIG. 1 taken from one side thereof.
Figure 4:
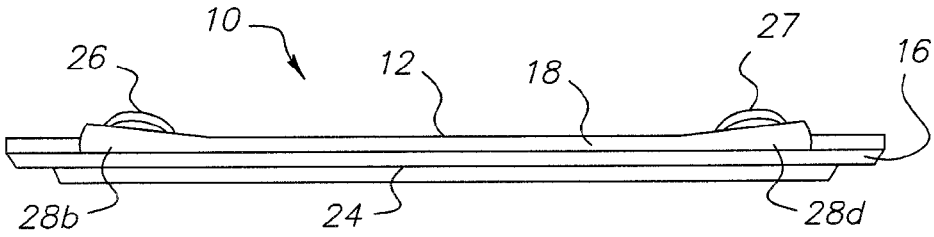
FIG. 4 is a bottom view of the apparatus of FIG. 1.
Figure 5:
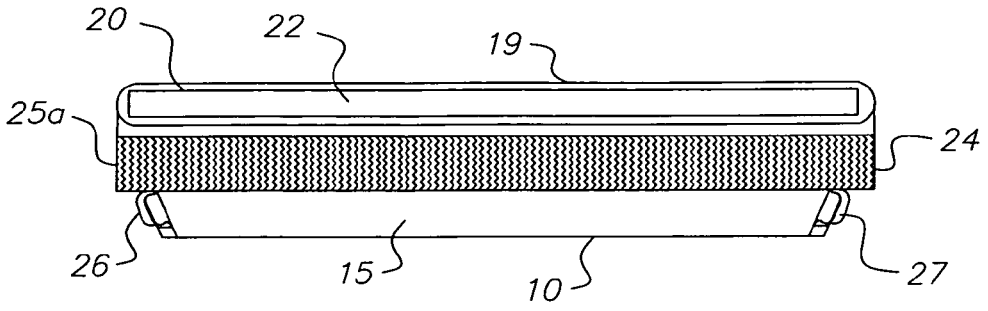
FIG. 5 is a top perspective of the apparatus of FIG. 1 with the top end of the housing open showing the bulletproof member therein.

Referring to FIGS. 1-5, the apparatus 10 of the present invention is shown having a housing 12 of flexible fabric material, such as heavy duty nylon, as used in backpacks and the like. Housing 12 has a front 15, a back 16, opposing sides 17*a* and 17*b*, and bottom and top ends 18 and 19, respectively. Bottom end 18 and sides 17*a* and 17*b* are closed, while top end 19 has an opening 20 (FIGS. 2 and 5) to enable housing 12 to serve as a pocket, bag, or flexible container having an interior into which a bulletproof member 22 is received, as shown in FIG. 5.

Figure 2:
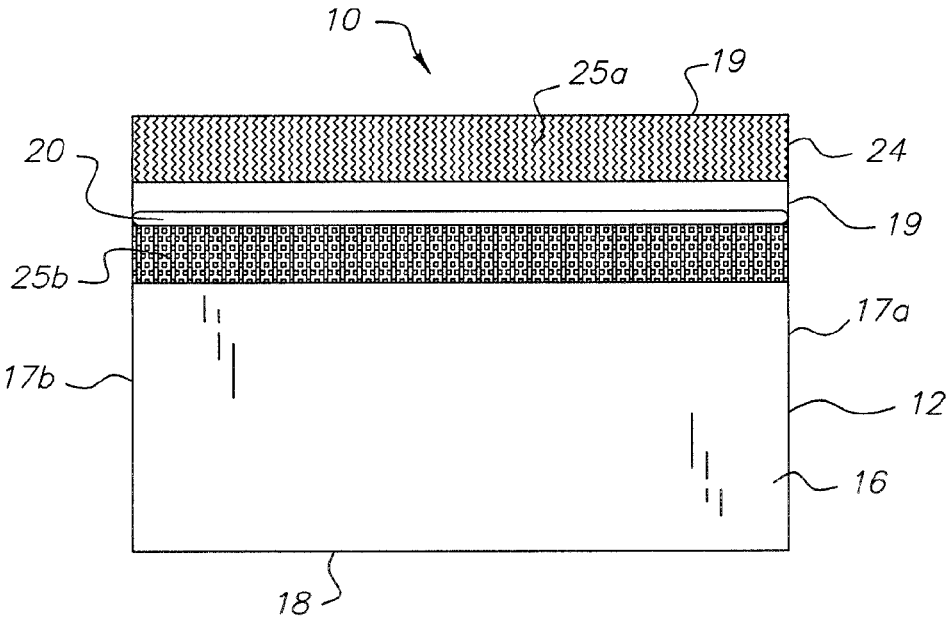
FIG. 2 is a back view of the apparatus of FIG. 1 with the top open.
Figure 9:
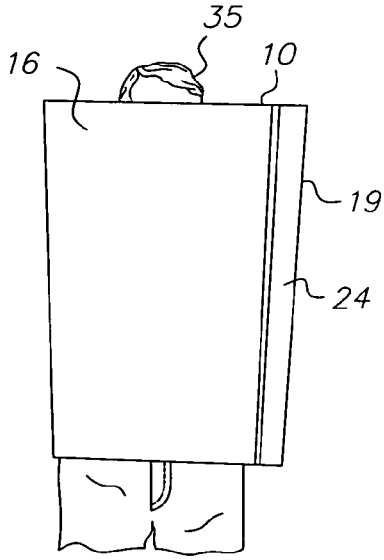

The material of the front 15 extends to provide a flap 24 which may fold over opening 20 to close top end 19. To releasably retain top end 19 closed, a releasable closure mechanism is provided by two strips 25*a* and 25*b* of Velcro. Strip 25*a* is of Velcro hook material and attached (such as sewn) to flap 24, as shown in FIGS. 2 and 5. Strip 25*b* is of Velcro latch material and is attached (such as sewn) along the top of back 16 near opening 20, such that flap 24 can be positioned to fold over the upper portion of back 19 having strip 25*b* to retain flap 24 in such position by attachment of strips 25*a* and 25*b* to each other, as best shown in FIGS. 3, 4, and 9. Top end 19 can be opened by pulling strips 25*a* and 25*b* apart while lifting flap 24 up to enable access to opening 20 and the interior of housing 12. Other means may also be used to releasably close and open end 19, such as snaps or zipper.

Figure 6:
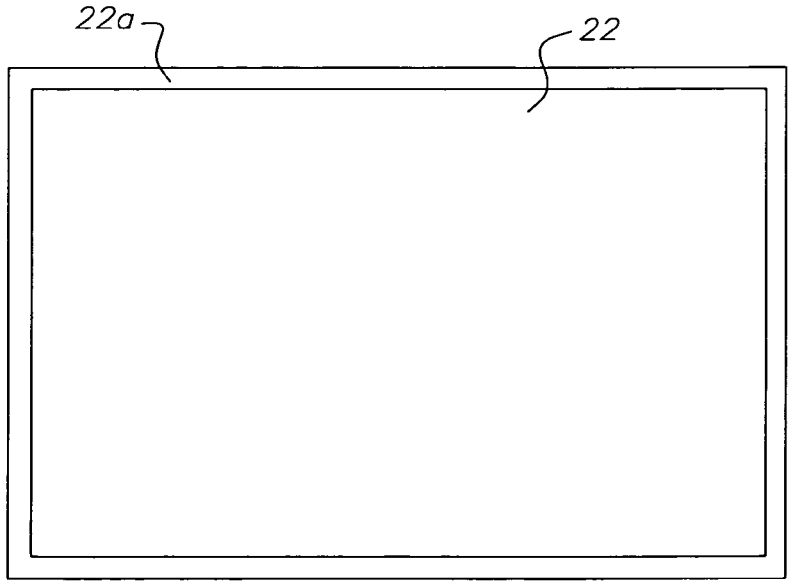
FIG. 6 is a front view of the bulletproof member of FIG. 5 apart from the housing of the apparatus of FIG. 1.

Bulletproof member 22 is a rigid rectangular sheet of ballistic material. Preferably, bulletproof member 22 is of aramid material as shown in FIG. 6, such as available form Automotive Armor, Mfg., Inc. of Palmetto, Fla., USA, having a 3000 Denier Aramid 17×17 weave with a plastic film resin that has thermoformable characteristics and is also a moisture barrier, providing a 12 ply Level IIIA board. Typically such aramid material is used as a panel to bulletproof cars or buildings. Preferably, member 22 is of Level IIIA material which will stop most handgun rounds, including a .44 magnum, but may be of other Ballistic Level protection. Aramid material for member 22 is preferred since it can be made sufficiently thin, lightweight, and bulletproof to enable operation in each one of the apparatus's dual modes, i.e., apparatus 10 is sufficient thin (e.g., ⅜ inch) that it can sit substantially flat on a desk surface and be used as a desk pad, and sufficiently lightweight (e.g., <5 lbs) and bulletproof (e.g., level IIIA) so that it can be easily handled as a shield and provide adequate protection from bullets. Although aramid material is preferred, member 22 may be of any other rigid material capable of withstanding bullets that is of the thickness and weight that facilitates use of apparatus 10 in each of its two modes.

For example, bulletproof member 22 may be a panel which is 18 inches in height, 26 inches in width, and ⅜ inches thick. Member 22 is not flexible and has flat or substantial flat front and back surfaces. The edges along the four sides of member 22 may have tape 22*a* to prevent fraying along the edges of the material composing member 22. Member 22 is placed in housing 12, via opening 20 at top end 19 (as shown in FIG. 5), and top end 19 closed by flap 24. Housing 12 may be slightly larger than the width and height of member 22 so that member 22 may slide in housing 12 and be contained therein without or little movability. Although member 22 is described as a single rigid member, multiple members of the same or different types of ballistic material may be used to provide member 22.

A pair of handles 26 and 27 are attached to the material of front 15 near, but spaced a distance from, sides 17*a* and 17*b*, respectively, such as sewn (preferably double sewn for added strength) at their respective opposite ends 26*a*, 26*b* and 27*a*, 27*b*, to form a loop or strap between ends 26*a*, 26*b* and 27*a*, 27*b* which provides gripping portion 26*c* and 27*c*, respectively. The material of the handles 26 and 27 may be the same or different from that of housing 12, and the sides of the material of grip portions 26*c* and 27*b* may be sewn together to make the handles 26 and 27, respectively, easier to grasp. For example, handles 26 and 27 may be 24.5 inches apart from each other about the length of front 15, spaced equidistant between ends 18 and 19, and each 0.75 inches from their respective side 17*a* or 17*b*. One benefit of the handles being present spaced a distance from sides 17*a* and 17*b* is that when the apparatus 10 is used as a shield the position of the handles along front 15 facilitates the user's hands when holding the handles being behind front 15 of apparatus 10 to shield the user's handles along with the part of the user's body behind apparatus 10.

Housing 12 may be made by sewing cut out fabric pieces of front 15 and back 16 together along or near their edges which meet along end 18 and opposite sides 17*a* and 17*b*, such that stitching lies along the inside of housing 12, leaving end 19 open with a flap 24. Optionally, the front and back material may be of the same piece of material folded to provide end 18 and sewn together along sides 17*a* and 17*b*. Although preferably, the fabric material for housing 12 is heavy duty nylon, other material may be used having sufficient strength to retain member 12 in housing 12 when handled by a user. Optionally, no flap 20 is provided and the top end 19 is sewn closed.

Figure 7:
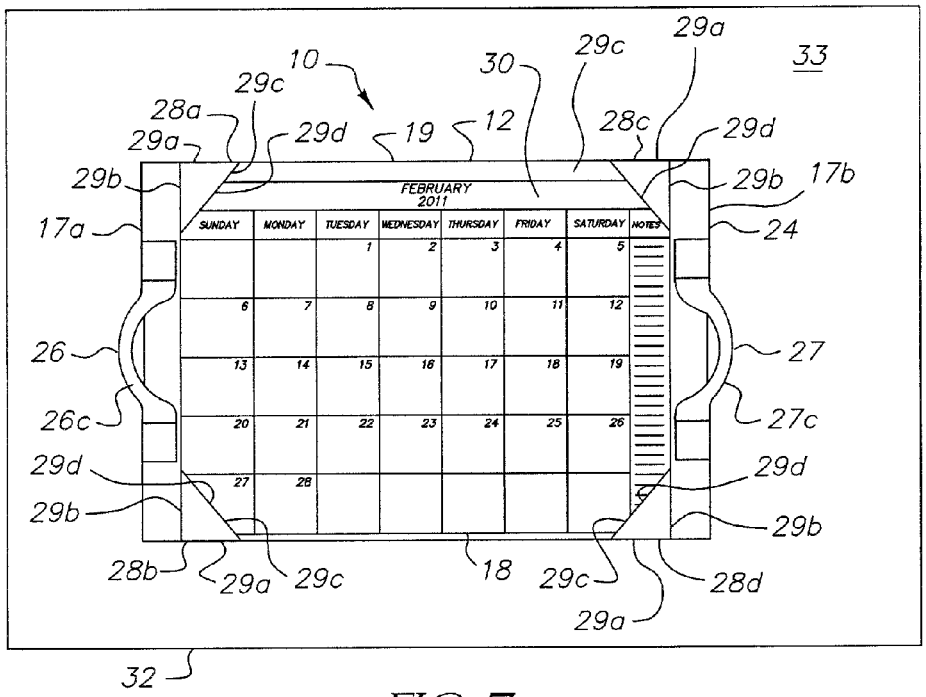
FIG. 7 is front view of the apparatus of FIG. 1 retaining a desktop calendar in corner holders, where the apparatus is shown, for example, on the top surface of a desk in a desktop item mode.

Four holders 28*a*, 28*b*, 28*c*, and 28*d* are provided along front 15 surface for retaining the corners of a rectangular member or item 30, such as a desk calendar, as shown in FIG. 7, where back 16 surface of apparatus 10 serves or operates in a desktop (or desk pad) mode lying upon the top surface 33 of a desk 32. Each holder 28*a-d* is a triangle piece of material having two sides 29*a* and 29*b* attached to front 15 of housing 12 forming a right angle, and a third diagonal side 29*c* which provides an opening 29*d* into the holder. Each holder 28*a*, 28*b*, 28*c*, and 28*d* provides a pocket or sleeve formed by the inside of the holder and the part of front 15 facing such inside of the holder receiving via opening 29*d* and retaining therein a portion of one of the four corners of rectangular member 30. This is achieved by holders 28*a*, 28*b*, 28*c*, and 28*d* being positioned along front 15 such that each can receive a portion of one of the four corners of rectangular member 30, thereby retaining rectangular member 30 along front 15 between handles 26 and 27.

Figure 1:
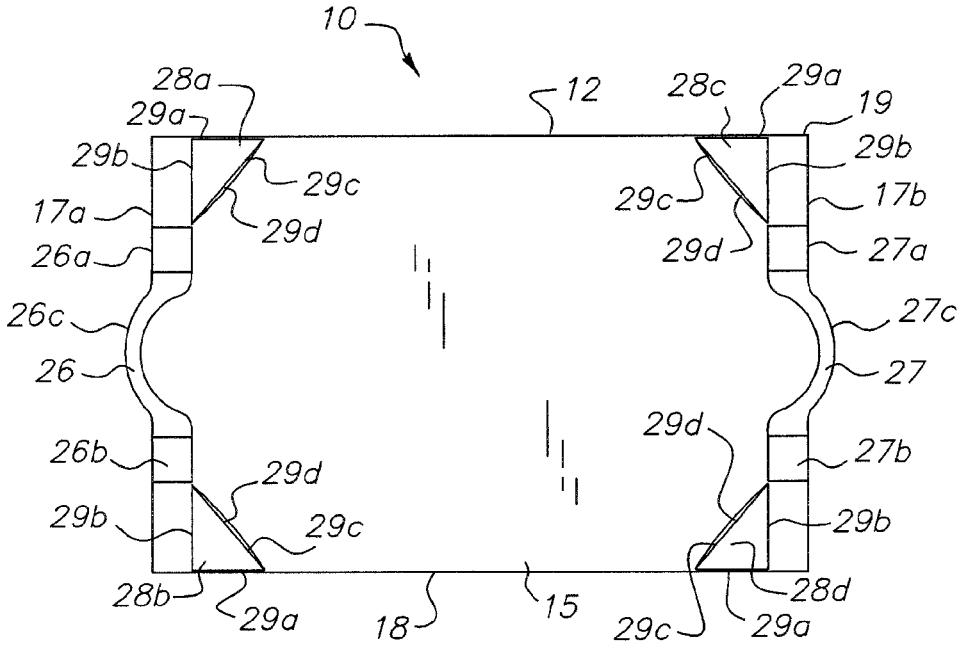
FIG. 1 is a front view of the apparatus of the present invention.

Sides 29*a* of holders 28*a* and 28*c* are aligned along front 15 at top end 19. Sides 29*a* of holders 28*b* and 28*d* are aligned along front 15 at bottom end 18. Sides 29*b* of holders 28*a* and 28*b* are vertically aligned and spaced from the edge of side 17*a* as best shown in FIGS. 1 and 7, so that handle 26 does not interfere with usage of rectangular member 30, when held by holders 28*a-d*. Similarly, sides 29*b* of holders and 28*d* are vertically aligned and spaced from the edge of side 17*b*, so that handle 27 does not interfere usage with rectangular member 30, when held by holders 28*a-d*. Each of the holders are attached (such as sewn) about their sides 29*a* and 29*b* to front 15 so that the sides 29*c* of each pair of diagonally opposing holders 28*a*, 28*d* and 28*b*, 28*c* are positioned to face each other so as to retain the corners of rectangular member 30, as shown in FIG. 7. The member 30 may frictionally engage holders 28*a-d* but moveable (or slidable) therein, and can hold different sized rectangular member 30. Holders 28*a-d* may be made of the same material as housing 12, or of different material, such as leather. Other items may also be held in holders 28*a-d*, such as the corners of a desk blotter (a rectangular cardboard based member), or other media or paper pad of similar size. An item retained by holders 28*a-d* is removable there from by pulling the item out of holders 28*a-d*, such as may be needed when replacing such item with another item of the same or different type. Handles 26 and 27 are positioned along front 15 of apparatus 10 so that they do not interfere with access or viewing rectangular member 30 not covered by the holders 28*a-d* (unless holders are of transparent or translucent material). Holders 28*a-d* may also be typical of corner holders of typical desk pads.

The corners of holders 28*a-d* are slightly larger than the corners of a typical rectangular member of a blotter paper or media, desktop calendar, paper pad or other typical item retained in a desk pad, so as enable insertion of the corners of the rectangular member. Thus, apparatus 10 is enabled to function as a desk pad, a common office desk item, in a desktop item mode (see FIG. 7 for example). A mode in which apparatus 10 is non-obstructing with use of apparatus 10 on a desk or on any other surface where a desk pad item would typical be used.

The back surface of rectangular member 30 lies flat and faces the surface of front 15 of apparatus 10. The apparatus 10 when operated in such desktop mode, the exterior surface of back 16 is located parallel upon top surface 33 of desk 32 or on any other surface where a desk pad item would typical be used, in which handles 26 and 27 are ready accessible for use if operation of the apparatus 10 in a bulletproof shield mode is needed as described below.

One feature of apparatus 10 is that with rectangular member 30 retained by holders, and back 16 upon surface 33 of desk 32, the overall height of member 30, although more than if on a typical desk pad, is still at a comfortable level for a user sitting at the desk to write upon the member 30 as desired, and thereby apparatus 10 in its desktop mode is unobtrusive to the user. Preferably, the raised level of front 15 of apparatus 10 with respect to the surface upon which back 16 lies is approximately a half inch, but other levels may be provided depending on the thickness of member 22 (which can vary depending on the material used for member 22) and thickness of the material forming housing 12. For example, 1 inch or less may be an acceptable raised level with a desired bulletproof level of member 22, so long as the overall weight of apparatus 10 does not make apparatus 10 difficult to use as shield when needed.

Figure 11:
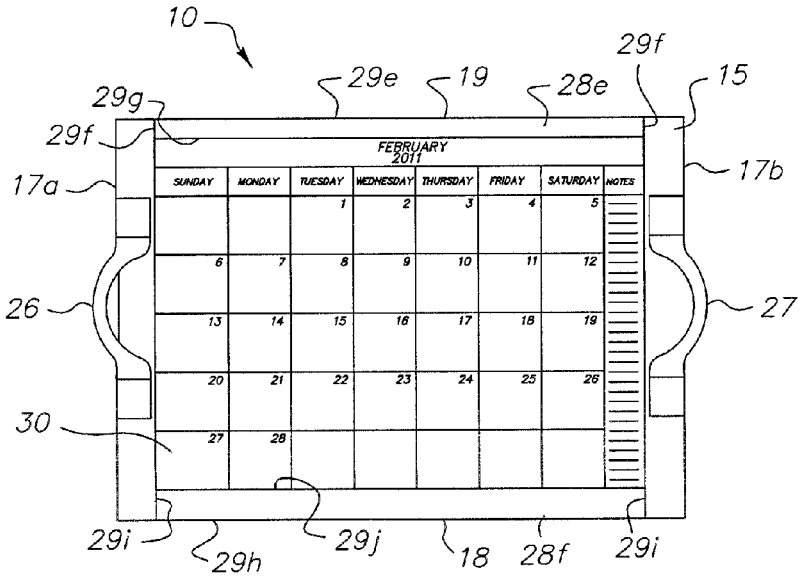
FIG. 11 is another front view of the apparatus of FIG. 1 retaining a desktop calendar in top and bottom holders.

Alternatively, instead of holders 28*a-d*, holders 28*e* and 28*f* may be used at the top and bottom, respectively, as shown for example in FIG. 11. Each holder 28*e* and 28*f* is a strip of material extending from the top and bottom ends 19 and 18, respectively, along front 15 of housing 12 centered about the width of apparatus 10. For example, each holder 28*e* and 28*f* may be about 24 inches is length and 0.75 inches in width, such that the left and right sides of a calendar 30 when retained in holders 28*e* and 28*f*, as shown in FIG. 11, are spaced a distance from handles 26 and 27, respectively, and thus from sides 17*a* and 17*b*, respectively. Holder 28*e* is sewn to front 15 along its top end 29*e* at or near top end 19 and along side ends 29*f* so as to provide an opening 29*g* along the bottom length of holder 28*e* so that holder 28*e* provides a pocket formed by the inside of holder 28*e* and the part of front 15 facing holder 28*e*. Holder 28*f* is sewn to bottom 18 along its bottom end 29*h* at or near end 18, and along side ends 29*i* so as to provide an opening 29*j* along the top length of holder 28*f* so that holder 28*f* provides a pocket formed by the inside of holder 28*f* and the part of front 15 facing holder 28*f*. Each holder 28*e* and 28*f* is sized to capture a portion of the top and bottom of a typical blotter or desktop calendar received via their openings 29*f* and 29*g*, respectively, sufficient to retain a top and bottom portion of a desktop calendar 30. Calendar 30 may frictionally engage holders 28*e* and 28*f* but moveable (or slidable) therein, and can hold different sized calendars. Holders 28*e* and 28*f* may be made of the same material as housing 12, or of different material, such as leather. Other items may also be held in holders 28*e* and 28*f*, such as the top and bottom portion of a desk blotter (a rectangular cardboard based member), or other media or paper pad of similar size to a desktop calendar. An item retained by holders 28*e* and 28*f* is removable there from by pulling the item out of holders 28*e* and 28*f*, such as may be needed when replacing such item with another item of the same or different type.

A combination of strip and corner holders may be used on front 15 of apparatus 10. For example, holders 28*e* of FIG. 11 and holders 28*b* and 28*d* of FIG. 7 may be used in combination to retain a top portion and the bottom two corners of a desktop calendar, desk blotter or other media, or for example; and, holder 28*f* of FIG. 11 and holders 28*a* and 28*c* of FIG. 7 may be used in combination to retain a bottom portion and the top two corners of the a desktop calendar, desk blotter, or other media. Of course, turning apparatus 10 with holders of the later example above 180 degrees with back 16 upon a flat surface the apparatus is the same as the first example due to symmetric nature of apparatus 10.

Holders 28*a-f* may be any one of typical holders used in common desk pads for retaining a rectangular member or item, such as a desktop calendar, blotter paper or media, paper pad, or the like. Although such holding means is described, other holding means typical of desk pads may be used to retain a portion of the top, sides, or corners of a typical rectangular member of a desk blotter to desktop calendar along front 15 of housing 12.

Figure 8:
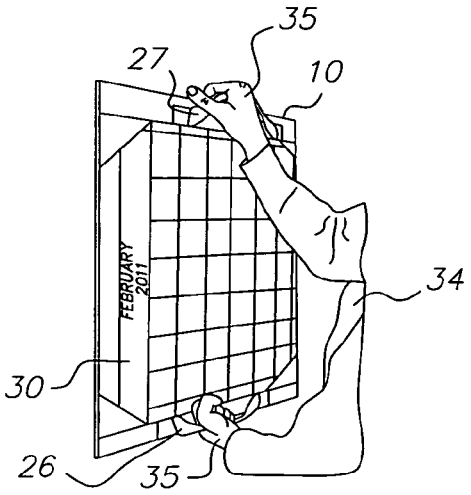
FIGS. 8 and 9 are front and back perspective views, respectively, of the apparatus of FIG. 1, with a retained desktop calendar shown for example, being grasped by a standing user in a bulletproof shield mode.
Figure 10:
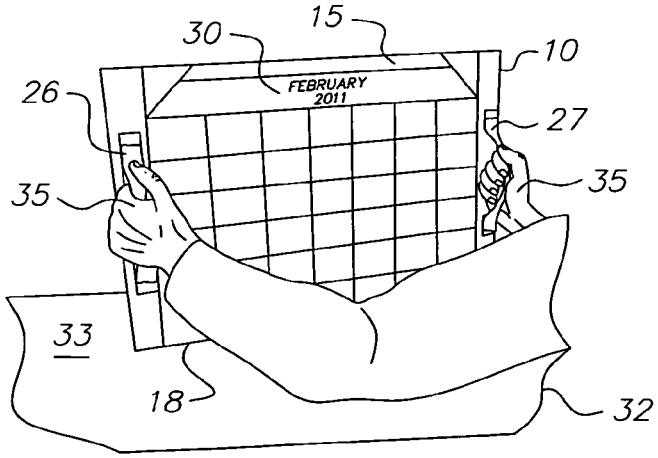
FIG. 10 is a perspective front view of the apparatus of FIG. 1 shown for example being grasped by a seated user in a bulletproof shield mode.

To operate apparatus 10 from in its bulletproof (or ballistic) shield mode, a user 34 (who is usually the same user of the apparatus 10 in the desktop item mode) grasps handles 26 and 27 with their hands 35 lifting away or tilting apparatus 10 upon the top surface 33 of his or her desk 32. The user 34 then can hold the apparatus 10 as a shield from gun fire as shown for example in FIGS. 8-10, with or without the desk item retained against front 15 of housing 12. With member 22 being, for example, of aramid material sized 18 inches in height, 26 inches in width, and ⅜ inches thick, apparatus 10 is lightweight being at or less than 5 lbs (e.g., about 4 lbs). Apparatus 10 can be lifted by a user and its back 16 pointed in the direction of gunfire or expected gunfire, while the user 34 holds the handles along the front 15 a distance from sides 17*a* and 17*b* such that hands 35 and the part of the user's body behind front 15 of apparatus 10 are protected. Although desk 32 is shown in FIG. 7, apparatus 10 can lay on desk, desk-like, or any surface where apparatus 10 can be utilized in its desktop item mode, and thus available for use also in shield mode when needed.

Thus a dual mode apparatus is provided which can be used as a common desk item, and at times of emergency in a shield mode to prevent life threatening injury from guns brought into such office environment. Although use is described in an office, the apparatus is not limited to such use, but can be used in any environment where a protective bulletproof device may be needed, and if needed, can also serve as a desk pad for retainer for a desktop calendar, blotter, media, paper pad, or the like. The different components of apparatus 10, e.g., housing 12, handles 26 and 27, or holders 28*a-f*, are of a color(s) or patterns desirable to users so as to blend with desk or workplace décor.

One feature of the apparatus 10 is that it can easily be positioned upright with only its bottom end 18 adjacent or touching desk surface 33, enabling a user sitting in a chair behind the desk with legs underneath the desk his or her upper body can be protected by apparatus 10 from gunfire, while the lower body has some protection afforded by the desk 32 itself, thereby enabling a level of total body protection.

Alternatively, no holders 28 are not provided and apparatus 10 is used solely in its shield mode when needed. Of course, the handles 26 and 27 may also be used to carry apparatus 10.

The releasable closure mechanism described earlier is advantageous since combinations of the same or different materials providing housing, handles, holders, such different types of fabrics (e.g., nylon or leather), colors, or patterns, provide different models of apparatus 10. Final apparatus 10 assembly of member 22 into housing 12 may be achieved by placing or replacing member 22 of apparatus 10 into the particular model of apparatus 10 desired. Replacement of member 22 may be by pulling flap 24 away from back surface 16 of apparatus 10 to release the Velcro attachment to open top end 19 (or if another type releasable closure mechanism actuation thereof to open the top end), open top end 19, and then remove member 22 via opening 20 from housing 12, and then the removed member 22 can placed into the housing 12, via open top end 19, of another apparatus 10, and then its top end closed. Final apparatus 10 assembly of member 22 into desired type or model of housing 12 may made after manufacture prior to shipment, or later by a distributors, stores, or customers.

The handles 26 and 27 are located to avoid negatively effecting use of apparatus 10 in its desktop mode (i.e., non-obstructing or non-intrusive), while making apparatus 10 easy to grasp for use in a shield mode. However other less preferable locations of handles may be used. For example, an additional pair of handles similar to handles 26 and 27 may be provided along the top and bottom of apparatus 10 by extending front 15 of housing 12 to accommodate such additional pair of handles. Even less preferably, such additional pair of handles along the top and bottom of the apparatus may be provided instead of handles 26 and 27. Also less preferably, instead of handles being attached to front 15, a pair handles may be provided one along one of top end 18 and the other along bottom end 19, and/or along each end of sides 17*a* and 17*b*, and/or at or near corners of housing 12, which may reduce the overall width of apparatus 10. A single handle along the top, bottom, or side of the apparatus may be used, rather than multiple handles, but such is less preferred since the apparatus 10 will be more difficult to use in a bullet shield mode. Preferably, the material of handles 26 and 27 may be of non-elastic or low elasticity, but handles may be made of elastic textile material such that when not held by a user their gripping portions lays against front 15, and when needed the handles are graspable and can stretch by pulling their gripping portion to the desired extent away from front 15, and then return to their previous position when not needed.

Although the housing 12 is shown rectangular, it can be made of other shapes and sizes, such a circular, by use of appropriately sizing member 22 to the interior of housing 10. Also, other dimensions of housing 12 and other way of assembling housing 12 than described herein may be used. The apparatus 10 may be used with end 19 being the bottom, and end 18 being the top, as desired by the user, in desktop item mode or shield mode. Preferably, when used in shield mode, end 19 is not directed downward since member 22 may accidentally fall out of housing 12 if the releasable closure mechanism provided to close end 19 is not sufficiently closed or inadvertently opens during usage of apparatus 10 in shield mode.

From the foregoing description, it will be apparent that an apparatus for a combined bulletproof shield and desk item has been provided. Variations and modifications of the herein described apparatus and other applications for the invention will undoubtedly suggest themselves to those skilled in the art. Accordingly, the foregoing description should be taken as illustrative and not in a limiting sense.

The invention claimed is:

1. An apparatus providing both a bulletproof shield and a desk item locatable upon the top surface of a desk comprising:

a rigid bulletproof member;

a housing enclosing said bulletproof member, in which said housing has exterior front and a back surfaces, and said housing when held by a user is sized to shield at least the upper torso, head, neck, and arms, of the user;

at least one pair of handles coupled to said housing to enable a user to operate said apparatus in a first mode by grasping one of said handles in each hand of the user and locating said apparatus to shield at least the upper torso, head, neck, arms, and hands of the user from one or more bullets, and at other times said apparatus being operable in a second mode with said back surface upon the top surface of a desk; and four pockets along said front surface, each of said pockets have an opening oriented for receiving in the pocket a different one of four corners of a rectangular member so that the rectangular member is retained along said front surface, and thereby facilitate use of the apparatus in said second mode as a common desk item.

2. The apparatus according to claim 1 wherein said housing is of flexible material and has a closed end and an open end through which said bulletproof member is received in said housing, and said apparatus further comprising means for releasably closing said open end when said member is received in said housing.

3. The apparatus according to claim 1 wherein said rectangular member is a desktop calendar or blotter.

4. The apparatus according to claim 1 wherein said housing is made of flexible fabric material.

5. The apparatus according to claim 1 wherein said housing is made of nylon material.

6. The apparatus according to claim 1 wherein said housing is rectangular shaped.

7. The apparatus according to claim 1 wherein said housing fits over said bulletproof material to limit movability of said bulletproof material within said housing.

8. The apparatus according to claim 1 wherein said handles are along said front surface.

9. The apparatus according to claim 1 wherein said handles are along said front surface, each of said handles is near different ones of opposite sides centered between top and bottom ends of said housing.

10. The apparatus according to claim 1 wherein said apparatus when operated in said second mode said back surface is locatable parallel with the top surface of the desk.

11. The apparatus according to claim 1 wherein said apparatus in said second mode lies 1 inches or less in height upon the desk.

* * * * *